United States Patent [19]

Horkin

[11] 4,359,699

[45] Nov. 16, 1982

[54] PIN DIODE ATTENUATOR EXHIBITING REDUCED PHASE SHIFT AND CAPABLE OF FAST SWITCHING TIMES

[75] Inventor: Philip R. Horkin, Littleton, Colo.

[73] Assignee: Martin Marietta Corporation, Bethesda, Md.

[21] Appl. No.: 247,455

[22] Filed: Mar. 25, 1981

[51] Int. Cl.[3] ..... H01P 1/22

[52] U.S. Cl. ..... 333/81 A; 333/238

[58] Field of Search ..... 333/81 R, 81 A; 323/364, 369

[56] References Cited

U.S. PATENT DOCUMENTS

| | | | |
|---|---|---|---|
| 3,518,585 | 6/1970 | Wilcox | 333/81 R |
| 3,870,976 | 3/1975 | Krause | 333/81 A X |
| 4,310,812 | 1/1982 | DeBloois | 333/81 A |

*Primary Examiner*—Paul L. Gensler

*Attorney, Agent, or Firm*—Sughrue, Mion, Zinn, Macpeak & Seas

[57] ABSTRACT

A variable attenuator is formed by a section of lossy transmission line having a plurality of PIN diodes in parallel with discrete sections of the line. A D.C. current flowing through the transmission line controls the effective resistances of the diodes and thereby varies the per unit length resistance of the line.

11 Claims, 5 Drawing Figures

PIN DIODE ATTENUATOR EXHIBITING REDUCED PHASE SHIFT AND CAPABLE OF FAST SWITCHING TIMES

BACKGROUND OF THE INVENTION

The present invention is directed to a variable microwave signal attenuator, and more particularly to such an attenuator utilizing PIN diodes as variable resistance elements.

Various attempts have been made to devise an attenuator circuit that will exhibit an impedance which is variable but is substantially independent of frequency over a wide range of microwave frequencies. Additional desirable characteristics are a minimum change in phase shift with changing attenuation, and high switching speeds so that the degree of attenuation can be quickly varied. In such devices, it is common to employ PIN diodes coupled in some fashion to a transmission line to act as variable impedance elements. In most applications, e.g. radar or communications systems, it is desirable that the impedance of any device coupled to the transmission line match the characteristic impedance of the line, since an impedance mismatch will cause a portion of the RF signal to be reflected at the mismatch junction.

A common technique is to couple PIN diodes in shunt between the transmission line conductor and ground as disclosed in U.S. Pat. No. 3,775,708 to Sly, or to arrange the PIN diodes in a $\pi$-pad configuration as disclosed in U.S. Pat. No. 4,010,430 to Wolfe. In such circuits, a D.C. bias current varies the effective resistances of the series and shunt diodes in order to control the degree of attenuation, but these circuits typically suffer from very high phase shift at maximum attenuation. In an attempt to reduce the phase shift, a "double-$\pi$" arrangement has been proposed by Williams in U.S. Pat. No. 4,097,827, with resistors being connected in shunt with the series diodes to thereby minimize the phase-shift effect of the diode junction capacitance. As a further solution to the phase-shift problem, U.S. Pat. No. 4,009,456 to Hopfer describes a Tee-Pi configuration using four PIN diodes with two of the diodes being coupled in series with a transmission line and two being coupled as parallel shunt resistances between ground and the common connection point of the two series-connected diodes. In the Hopfer configuration, phase shifts are minimized by reducing the PIN diode parasitics as much as possible.

Although these various PIN diode attenuator circuits are acceptable in a number of applications, they all still suffer from excessive phase shift at increasing degrees of attenuation. Further, some configurations utilize a plurality of series-connected diodes and, when changing the degree of attenuation, one of the diodes will inevitably turn off first and the remaining diodes will then have to discharge through the high impedance of the "off" diode. This substantially limits the switching speed of the attenuator.

Still further, although some circuits have succeeded in improving the phase shift characteristics, they have invariably done so at the expense of increased circuit complexity and consequent higher fabrication costs.

SUMMARY OF THE INVENTION

It is an object of this invention to provide a PIN diode attenuator exhibiting reduced phase shift with changing attenuation.

It is a further object of this invention to provide such an attenuator capable of faster switching times than conventional such devices.

It is a still further object of this invention to provide a PIN diode attenuator which is simple in both construction and operation and will also exhibit an improved failure rate.

Briefly, these and other objects are achieved according to the present invention by a PIN diode attenuator which includes a lossy transmission line conductor having a plurality of PIN diodes connected in parallel with discrete sections of the conductor to thereby act as series-shunt resistances. The resistance values of the PIN diodes are controlled by a D.C. current flowing through the transmission line section. All diodes have a relatively low impedance discharge pass through the resistive transmission line material thus enabling higher switching speeds, and with a proper selection of R, the per unit length resistance of the transmission line material, phase shift at increasing degrees of attenuation can be kept to an acceptable minimum. The attenuator according to the present invention is quite simple in design and operation, and since the diodes are each connected in parallel with a section of transmission line and are coupled in series with one another, the failure of a particular PIN diode will not render the circuit inoperable.

BRIEF DESCRIPTION OF THE DRAWINGS

The present invention will be more clearly understood with reference to the following description in conjunction with the accompanying drawings in which.

DETAILED DESCRIPTION OF THE PREFERRED EMBODIMENT

Figure 1:
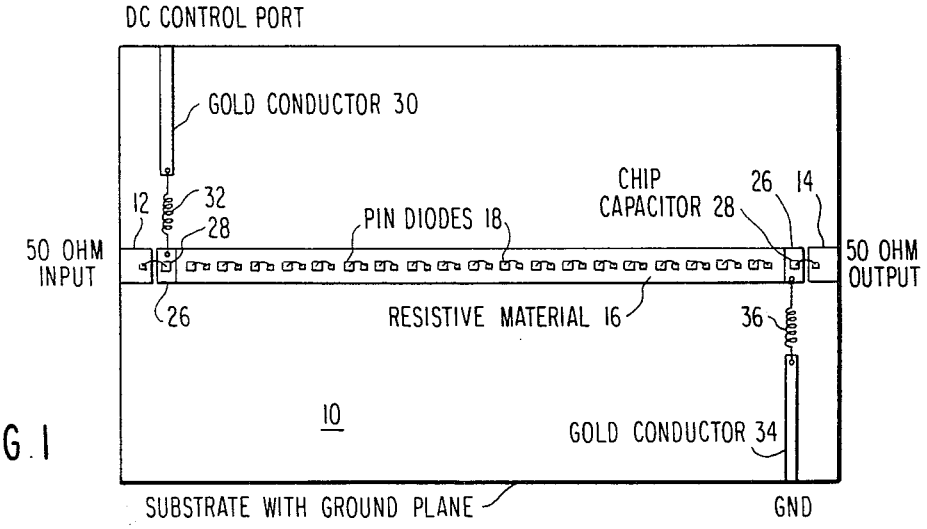
FIG. 1 is a plan view of essential components of the PIN diode attenuator according to the present invention.
Figure 2:
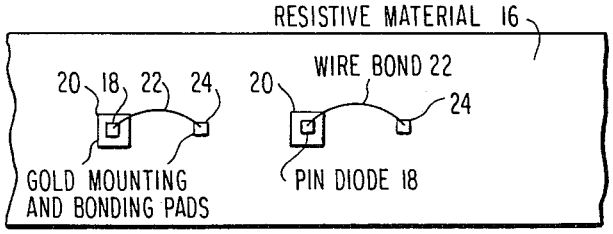
FIG. 2 is an enlarged plan view of a portion of the transmission line attenuator shown in FIG. 1.

FIG. 1 is a plan view of essential components of a PIN diode attenuator according to the present invention. The attenuator includes a substrate 10 having a ground plane (not shown) on its lower surface. A gold microstrip line 12 provides an RF input from, for example, a 50 ohm transmission line, and the output of the attenuator is provided to a similar gold microstrip line 14. The attenuator itself comprises a strip 16 of lossy material, e.g. nichrome compounds which are normally used to implement resistors, having a plurality of PIN diodes 18 disposed thereon. As shown more clearly in FIG. 2, the anodes of the PIN diodes are coupled to the resistive material 16 via gold mounting pads 20, and the cathodes of the diodes are coupled to a "downstream" portion of the resistive material via wire bonds 22 and gold bonding pads 24.

In order to facilitate connection of the attenuator to the input and output microstrip lines and to the bias circuitry for the PIN diodes, a section of gold microstrip 26 is provided at either end of the resistive material 16. These gold sections 26 are coupled to the input and output transmission lines via coupling chip capacitors 28.

The D.C. bias required to control the attenuation factor is provided by gold conductor 30 which is coupled to the resistive material via coil 32 and gold microstrip 26, and a similar gold conductor 34 coupled to the other end of the resistive material 16 through coil 36 and gold microstrip 26. With conductor 34 grounded, a D.C. control voltage applied to the conductor 30 will provide a D.C. bias current flowing through coil 32, resistive material 16 and coil 36 to ground. This D.C. current will be isolated from the surrounding 50 ohm transmission lines by D.C. blocking capacitors 28 and, as is well known, the coils 32 and 36 will pass the D.C. bias current but will isolate the transmission line attenuator from the bias circuitry.

Figure 3:
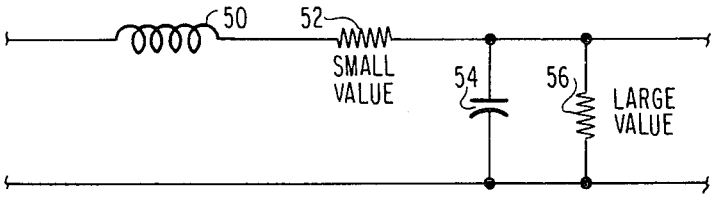
FIG. 3 is a brief schematic diagram of the equivalent circuit of a discrete section of transmission line.
Figure 4:
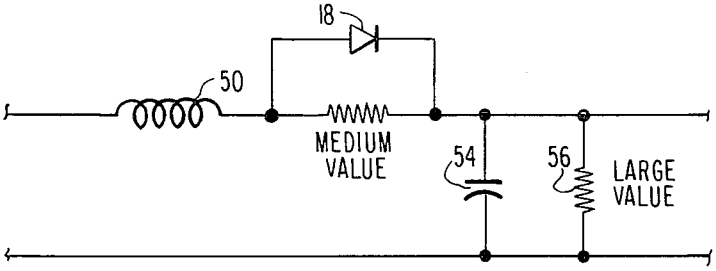
FIG. 4 is a brief schematic diagram of the equivalent circuit of a transmission line section including a PIN diode according to the present invention.
Figure 5:
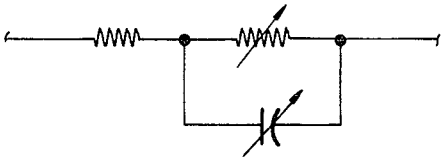
FIG. 5 is a brief schematic diagram of the equivalent circuit of a common PIN diode.

The spacing between PIN diodes 18 along the resistive line 16 should be much less than a quarter wavelength at the highest operating frequency of the attenuator so that the overall resistance of the resistive line 16 for all operating frequencies can be controlled by varying the individual resistances of the discrete portions of the line at which the PIN diodes are connected. The effect of the PIN diodes can be more clearly understood by referring to the schematic diagrams of FIGS. 3–5. As shown in FIG. 3, the equivalent circuit of a discrete portion of a conventional transmission line includes an inductance 50 and resistance 52 corresponding to the inductance and resistance provided by the material of the line, and a capacitance 54 and resistance 56 which are provided by the dielectric substrate between the line and the ground plane. FIG. 4 is a schematic diagram of the discrete resistive line section according to the present invention with the addition of a PIN diode. The value of resistance 52 can be made larger, and the diode, having an equivalent circuit as shown in FIG. 5, acts as a variable resistance in parallel with the resistance value of the discrete resistive line portion. As the forward biasing of the diode 18 in FIG. 4 increases, its resistance will decrease and the effective resistance of that portion of the attenuator line will decrease. This will result in a smaller degree of attenuation. On the other hand, if the forward bias current through the diode 18 is kept to a minimum, the resistance of the discrete portion of the attenuator line will be substantially unchanged and a maximum degree of attenuation will be realized.

The characteristic impedance of an incremental length of transmission line is given by $$Z_o = \left| \frac{(R + j\omega L)}{(G + j\omega C)} \right|^{\frac{1}{2}}$$

where R is the series resistance per unit length and G is the dielectric conductance per unit length. As will be appreciated, varying only the resistance R will cause a change in the impedance, but this change is desensitized by the square root function and is also slightly frequency dependent. With a suitable choice of R (where maximum R corresponds to maximum attenuation and a zero value of R corresponds to minimum attenuation) for a given frequency range, an acceptable compromise between maximum attenuation per unit length and impedance can be realized. Thus, a maximum value of voltage standing wave ratio (VSWR) can therefore be guaranteed. This may require reducing the maximum loss per unit length for very high frequencies, thus making the attenuator physically longer to achieve a given dynamic range. Since the characteristic impedance of the line is substantially non-varying over the range of attenuation, a substantially constant transmission phase shift is assured.

The switching speed of the attenuator is improved with respect to conventional such devices. Since the entire structure can be implemented using relatively low resistivity material for the resistive line 16, all of the PIN diodes will at all times have a relatively low impedance discharge path through this resistive material, thus lowering the RC time constant at the control port and enabling switching between attenuation values in less than 1 microsecond.

In addition to the above advantages in reduced phase shift and increased switching speed, it will be apparent that the attenuator shown in FIG. 1 is quite simple in design and construction. The disclosed embodiment of the invention is a microstrip construction of the type well known in the art, and it is unnecessary for the purposes of describing this invention to include herein either a cross sectional view of the device or a detailed description of the fabrication techniques involved. However, it is clear that the fabrication will be quite simple since the number of components illustrated in FIG. 1 are relatively few, with the exception of the PIN diodes 18 which can all be fabricated simultaneously.

A still further advantage is that the variation of the attenuation depends on controlling the effective resistance of the attenuator transmission line, with the individual effects of the PIN diodes being additive in nature. Thus, if one of the PIN diodes fails, the operation of the remaining diodes will be substantially unaffected and the attenuator will remain operable.

It should be appreciated that, while only a single embodiment of the invention has been described and illustrated, various changes could be made without departing from the spirit and scope of the invention as defined in the following claims.

What is claimed is:

1. A microwave signal attenuator for variably attenuating an rf signal, said attenuator comprising:

an attenuating conductor of resistive material, said attenuating conductor having input and output ends and extending in a conducting direction from said input end to said output end;

means for coupling an rf signal to said input end for propagation along said conductor in said conducting direction from said input end to said output end, and means for coupling an attenuated rf signal from said output end;

diode means having an anode and a cathode, the anode and cathode of said PIN diode means being coupled to said resistive material at first and second points which are offset from one another along said conducting direction, whereby said diode means is connected in parallel with a first segment of said attenuating conductor between said first and second points; and biasing means for variably biasing said PIN diode means to thereby control the degree of attenuation of said microwave signal attenuator.

2. A microwave signal attenuator as defined in claim 1, wherein said resistive material differs from the materials comprising said diode means.

3. A microwave signal attenuator as defined in claim 1, wherein said diode means comprises a plurality of PIN diodes including at least a first PIN diode having said anode and cathode coupled to said resistive material at said first and second points, and a second PIN diode having an anode and cathode coupled to said conductor, said second diode being connected in parallel with a second segment of said attenuating conductor offset with respect to said first segment along said conducting direction.

4. A microwave signal attenuator as defined in claim 3, wherein said plurality of PIN diodes span non-overlapping segments of said attenuating conductor.

5. A microwave signal attenuator as defined in claims 3 or 4, wherein said resistive material is formed on a dielectric substrate, said input signal being received from an input microstrip line and said output signal being coupled to an output microstrip line, the characteristic impedance of said attenuating conductor being substantially the same as that of said input and output microstrip lines.

6. A microwave signal attenuator as defined in claim 5, wherein said biasing means provides a D.C. bias between said input and output ends of said attenuating conductor.

7. A microwave signal attenuator as defined in claim 5, wherein said PIN diodes are oriented with their cathodes closer to the output end of said attenuating conductor than their anodes.

8. A microwave signal attenuator as defined in claim 5, wherein said input and output ends of said attenuating conductor comprise microstrip conductor sections of a material of lower resistivity than said resistive material.

9. A microwave signal attenuator as defined in claim 5, wherein said coupling means comprises input and output capacitors for coupling said attenuating conductor to said input and output microstrip lines, respectively.

10. A microwave signal attenuator as defined in claim 5, wherein said resistive material is a nichrome compound.

11. A microwave signal attenuator as defined in claim 5, wherein said biasing means comprises:

a first biasing conductor for receiving a D.C. bias signal;

a first inductor connected between said first biasing conductor and said input end of said attenuating conductor;

a second biasing conductor coupled to a constant potential; and a second inductor connected between said second biasing conductor and said output end of said attenuating conductor.

* * * * *